US008234023B2

(12) United States Patent
Kumar

(10) Patent No.: US 8,234,023 B2
(45) Date of Patent: Jul. 31, 2012

(54) SYSTEM AND METHOD FOR REGULATING SPEED, POWER OR POSITION OF A POWERED VEHICLE

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 543 days.

(21) Appl. No.: 12/483,334

(22) Filed: Jun. 12, 2009

(65) Prior Publication Data

US 2010/0318247 A1 Dec. 16, 2010

(51) Int. Cl.
*G06F 7/00* (2006.01)

(52) U.S. Cl. ..... 701/20; 701/93; 701/19

(58) Field of Classification Search ..... 701/19–20, 701/93; 180/170; 340/441
See application file for complete search history.

(56) References Cited

U.S. PATENT DOCUMENTS

| | | | | |
|---|---|---|---|---|
| 2,104,652 | A | | 1/1938 | Inman |
| 2,601,634 | A | | 6/1952 | Rivette |
| 2,927,711 | A | | 3/1960 | Naggiar |
| 3,781,139 | A | | 12/1973 | Lohse |
| 3,794,833 | A | | 2/1974 | Blazek et al. |
| 3,886,870 | A | | 6/1975 | Pelabon |
| 3,948,314 | A | | 4/1976 | Creswick et al. |
| 4,028,884 | A | * | 6/1977 | Martz et al. ..... 60/39.182 |
| 4,136,432 | A | | 1/1979 | Melley, Jr. |
| 4,548,164 | A | | 10/1985 | Ylonen et al. |
| 4,617,627 | A | | 10/1986 | Yasunobu et al. |
| 4,644,705 | A | | 2/1987 | Saccomani et al. |
| 4,663,713 | A | | 5/1987 | Cornell et al. |
| 4,843,575 | A | | 6/1989 | Crane |
| 5,181,541 | A | | 1/1993 | Bodenheimer |
| 5,187,945 | A | | 2/1993 | Dixon |
| 5,197,627 | A | | 3/1993 | Disabato et al. |
| 5,239,472 | A | | 8/1993 | Long et al. |
| 5,240,416 | A | | 8/1993 | Bennington |
| 5,253,153 | A | | 10/1993 | Mathews et al. |

(Continued)

FOREIGN PATENT DOCUMENTS

CH 642 418 4/1984

(Continued)

OTHER PUBLICATIONS

Razouqi et al. RYNSORD: A Novel, Decentralized Algorithm for Railway Networks with 'Soft Reservation', VTC, 1998, pp. 1585-2589, V3, New York, NY.

(Continued)

*Primary Examiner* — Yonel Beaulieu
(74) *Attorney, Agent, or Firm* — GE Global Patent Operation; John A. Kramer

(57) ABSTRACT

A system for regulating the speed, position and/or power of a powered vehicle, which is traveling on a track system according to a planned trip. The system comprises a database having data relative to the planned trip including a plurality of elapsed travel times associated with a planned speed, position and power. One or more controllers provide data including data relative to an operating speed, position and power of the vehicle during the trip and an operating time at which the vehicle is traveling at the operating speed, power or position. A regulator may adjust the operating parameter of the vehicle if the difference between the vehicle operating data and planned trip data exceeds a predetermined threshold speed.

22 Claims, 5 Drawing Sheets

U.S. PATENT DOCUMENTS 5,316,174 A 5/1994 Schutz
5,363,787 A 11/1994 Konopasek et al.
5,388,034 A 2/1995 Allen et al.
5,460,013 A 10/1995 Thomsen
5,487,516 A 1/1996 Murata et al.
5,623,413 A 4/1997 Matheson et al.
5,642,827 A 7/1997 Madsen
5,651,330 A 7/1997 Jewett
5,755,349 A 5/1998 Brundle
5,794,172 A 8/1998 Matheson et al.
5,803,411 A 9/1998 Ackerman et al.
5,957,571 A 9/1999 Koster et al.
5,998,915 A 12/1999 Scholz et al.
6,092,021 A 7/2000 Ehlbeck et al.
6,123,111 A 9/2000 Nathan et al.
6,129,025 A 10/2000 Minakami et al.
6,198,993 B1 3/2001 Higashi et al.
6,216,957 B1 4/2001 Turunen, Jr.
6,230,668 B1 5/2001 Marsh et al.
6,243,694 B1 6/2001 Bonissone et al.
6,263,266 B1 7/2001 Hawthorne
6,270,040 B1 8/2001 Katzer
6,325,050 B1 12/2001 Gallagher et al.
6,332,106 B1 12/2001 Hawthorne et al.
6,363,331 B1 3/2002 Kyrtsos
6,380,639 B1 4/2002 Soucy
6,404,129 B1 6/2002 Hendricx et al.
6,434,452 B1 8/2002 Gray
6,459,964 B1 10/2002 Vu et al.
6,520,124 B2 2/2003 Bohm, II
6,549,803 B1 4/2003 Raghavan et al.
6,647,328 B2 11/2003 Walker
6,676,089 B1 1/2004 Katzer
6,698,913 B2 3/2004 Yamamoto
6,702,235 B2 3/2004 Katzer
6,873,888 B2 3/2005 Kumar
6,910,792 B2 6/2005 Takada et al.
6,948,837 B2 9/2005 Suzuki
6,953,272 B2 10/2005 Hayakawa et al.
6,973,947 B2 12/2005 Penaloza et al.
7,072,747 B2 7/2006 Armbruster et al.
7,072,757 B2 7/2006 Adams et al.
7,073,753 B2 7/2006 Root et al.
7,096,171 B2 8/2006 Hawthorne et al.
7,131,403 B1 11/2006 Banga et al.
7,164,975 B2 1/2007 Bidaud
7,302,895 B2 12/2007 Kumar et al.
7,347,168 B2 3/2008 Reckels et al.
7,349,797 B2 3/2008 Donnelly et al.
7,497,201 B2 3/2009 Hollenbeck
7,500,436 B2 3/2009 Kumar et al.
7,509,193 B2 3/2009 Kustosch
7,522,990 B2 4/2009 Daum et al.
7,618,011 B2 11/2009 Oleski et al.
7,667,611 B2 2/2010 Lindsey et al.
2001/0029411 A1 10/2001 Hawthorne
2001/0047241 A1 11/2001 Khavakh et al.
2002/0072833 A1 6/2002 Gray
2002/0093201 A1 7/2002 Soucy
2002/0107618 A1 8/2002 Deguchi et al.
2002/0174653 A1 11/2002 Uzkan
2003/0001050 A1 1/2003 Katzer
2003/0034423 A1 2/2003 Hess, Jr. et al.
2003/0076221 A1 4/2003 Akiyama et al.
2003/0091017 A1 5/2003 Davenport et al.
2003/0104899 A1 6/2003 Keller
2003/0105561 A1 6/2003 Nickles et al.
2003/0120400 A1 6/2003 Ahmed Baig et al.
2003/0183729 A1 10/2003 Root et al.
2003/0222981 A1 12/2003 Kisak et al.
2003/0229446 A1 12/2003 Boscamp et al.
2003/0233959 A1 12/2003 Kumar
2004/0068359 A1 4/2004 Neiss et al.
2004/0098142 A1 5/2004 Warren et al.
2004/0104312 A1 6/2004 Hess, Jr. et al.
2004/0108814 A1 6/2004 Tsuda et al.
2004/0122569 A1 6/2004 Bidaud
2004/0129289 A1 7/2004 Hafemann
2004/0133315 A1 7/2004 Kumar et al.
2004/0172175 A1 9/2004 Julich et al.
2004/0174121 A1 9/2004 Tsuda et al.
2005/0007020 A1 1/2005 Tsuda et al.
2005/0055287 A1 3/2005 Schmidtberg et al.
2005/0085961 A1 4/2005 Kane et al.
2005/0109882 A1 5/2005 Armbruster et al.
2005/0121005 A1 6/2005 Edwards
2005/0171655 A1 8/2005 Flynn et al.
2005/0171657 A1 8/2005 Kumar
2005/0188745 A1 9/2005 Staphanos et al.
2005/0196737 A1 9/2005 Mann
2005/0205719 A1 9/2005 Hendrickson et al.
2005/0251299 A1 11/2005 Donnelly et al.
2005/0288832 A1 12/2005 Smith et al.
2006/0041341 A1 2/2006 Kane et al.
2006/0047379 A1 3/2006 Schullian et al.
2006/0060345 A1 3/2006 Flik et al.
2006/0085103 A1 4/2006 Smith, Jr. et al.
2006/0085363 A1 4/2006 Cheng et al.
2006/0116789 A1 6/2006 Subramanian et al.
2006/0116795 A1 6/2006 Abe et al.
2006/0122737 A1 6/2006 Tani et al.
2006/0155434 A1 7/2006 Kane et al.
2006/0162973 A1 7/2006 Harris et al.
2006/0212188 A1 9/2006 Kickbusch et al.
2006/0277906 A1 12/2006 Burk et al.
2006/0282199 A1 12/2006 Daum
2007/0061053 A1 3/2007 Zeitzew
2007/0112475 A1 5/2007 Koebler et al.
2007/0219680 A1 9/2007 Kumar et al.
2007/0219681 A1 9/2007 Kumar et al.
2007/0219683 A1 9/2007 Daum et al.
2007/0233364 A1 10/2007 Kumar
2007/0260369 A1 11/2007 Philp et al.
2007/0261648 A1 11/2007 Reckels et al.
2008/0004721 A1 1/2008 Huff et al.
2008/0128563 A1 6/2008 Kumar et al.
2008/0147256 A1 6/2008 Liberatore
2008/0208393 A1 8/2008 Schricker
2009/0140574 A1 6/2009 Gorman et al.
2009/0177345 A1 7/2009 Severinsky et al.
2009/0254239 A1 10/2009 Daum et al.
2009/0319092 A1 12/2009 Piche
2010/0152998 A1 6/2010 Schwarzmann

FOREIGN PATENT DOCUMENTS

DE 197 26 542 11/1998
DE 198 30 353 2/2001
DE 199 35 349 2/2001
DE 199 35 353 2/2001
DE 100 45 921 3/2002
EP 0 594 226 9/1990
EP 0 428 113 11/1990
EP 1 136 969 7/2002
EP 1 466 803 10/2004
EP 1 253 059 8/2006
FR 2 129 215 10/1972
FR 2 558 806 1/1984
FR 2 767 770 9/1997
GB 482 625 12/1936
JP 60 028153 2/1985
JP 50-32733 9/1993
JP 06-108869 4/1994
JP 2001-065360 3/2001
WO WO 95/25053 9/1995
WO WO 99/014093 3/1999
WO WO 03/097424 11/2003
WO WO 2004/023517 3/2004
WO WO 2004/051699 6/2004
WO WO 2004/052755 6/2004
WO WO 2004/059446 7/2004
WO WO 2004/051700 7/2005
WO WO 2005/061300 3/2007
WO WO 2007/027130 3/2007
WO WO 2007/091270 8/2007

OTHER PUBLICATIONS

ISR and WO pertaining to International application No. PCT/US2009/032933 dated Nov. 3, 2009.
Chang et al. "Cycle Detection in Repair-Based Railway Scheduling System", Robotics and Automation, 1996 pp. 2517-2522, V3, New York, NY.
Grabs, Ulrike, "Modification of Electronic Interlocking El S in Service", Signal + Draht, Telzlaff Verlag GmbH, 1995, pp. 254-258, V87(7/08), Darmstadt, DE.
Cheng, Yu, "Hybrid Simulation for Resolving Resource conflicts in Train Traffic Rescheduling", Computers in Industry, 1998, pp. 233-246, V35(3), Amsterdam, NL.
ISR and WO pertaining to International application No. PCT US2006/032893 dated Aug. 24, 2006.
ISR and WO pertaining to International application No. PCT/US2007/001428 dated Jan. 18, 2007.
ISR and WO pertaining to International application No. PCT/US2007/066697 dated Apr. 16, 2007.
ISR and WO pertaining to International application No. PCT/US2007/076699 dated Aug. 24, 2007.
ISR and WO pertaining to International application No. PCT/US2007/078001 dated Sep. 10, 2007.
ISR and WO pertaining to International application No. PCT/US2007/078016 dated Sep. 10, 2007.
ISR and WO pertaining to International application No. PCT/US2007/078118 dated Sep. 11, 2007.
ISR and WO pertaining to International application No. PCT/US2007/078340 dated Sep. 13, 2007.
ISR and WO pertaining to International application No. PCT/US2008/063193 dated May 9, 2008.
ISR and WO pertaining to International application No. PCT/US2008/083526 dated Nov. 14, 2008.
ISR and WO pertaining to International application No. PCT/US2009/031740 dated Jan. 23, 2009.
ISR and WO pertaining to International application No. PCT/US2009/032933 dated Feb. 3, 2009.
ISR and WO pertaining to International application No. PCT/US2009/037293 dated Mar. 16, 2009.
ISR and WO pertaining to International application No. PCT/US2009/045004 dated May 22, 2009.
ISR pertaining to International application No. PCT/US2010/035058 dated May 17, 2010.
ISR pertaining to International application No. PCT/US2010/047251 dated Aug. 31, 2010.

* cited by examiner

SYSTEM AND METHOD FOR REGULATING SPEED, POWER OR POSITION OF A POWERED VEHICLE

BACKGROUND OF THE INVENTION

Embodiments of the invention pertain generally to systems or methods used to control a vehicle traveling along a route. Other embodiments of the invention pertain to such systems that may be used on locomotives in a train traveling on a railroad track.

Systems and methods for developing a trip plan for vehicle assets such as locomotives and trains have been disclosed, and are designed for operating the locomotives at optimal speeds and power settings while minimizing fuel consumption and/or emissions. For example, in the commonly owned published application U.S. Publication No. 2007-0219680-A1 (incorporated by reference herein in its entirety) there is disclosed a method and closed loop system for optimizing a train trip using speed signal information, which is also schematically illustrated in FIG. 1. In such a system, data relative to locomotive/train characteristics and railroad track systems are used to generate a trip plan. Such input information includes, but is not limited to, train position, consist composition (such as locomotive models), locomotive tractive power performance of locomotive traction transmission, consumption of engine fuel as a function of output power, cooling characteristics, intended trip route (effective track grade and curvature as function of milepost or an "effective grade" component to reflect curvature, following standard railroad practices), car makeup and loading (including effective drag coefficients), desired trip parameters including, but not limited to, start time and location, end location, travel time, crew (user and/or operator) identification, crew shift expiration time, and trip route. Based on the specification data input, an optimal trip plan that minimizes fuel use and/or generated emissions subject to speed limit constraints and a desired start and end time is computed to produce a trip profile. The profile contains the optimal speed and power (e.g., notch/throttle) settings for the train to follow, expressed as a function of distance and/or time from the beginning of the trip, train operating limits (including but not limited to, the maximum notch power and brake settings), speed limits as a function of location, and the expected fuel used and emissions generated.

In such a system and during the course of a trip, the actual speed of the locomotive is monitored and compared to the trip plan, which includes data relative to the optimal speed of the locomotive at various positions on the track. If the locomotive is not operating at the optimal speed, or within a range of the optimal speed according to the trip plan, the speed is adjusted either manually or by an automated controller. In addition, the trip plan may be changed during the course of executing a planned trip. That is, events during daily operations may motivate the generation of a new or modified plan, including a new or modified trip plan that retains the same trip objectives, for example, when a train is not on schedule for a planned meet or pass with another train and therefore must make up the lost time.

Using the actual speed, power, and location of the locomotive, a planned arrival time is compared with a currently estimated (predicted) arrival time. Based on a difference in the times, as well as the difference in parameters (detected or changed by dispatch or the operator), the plan is adjusted. This adjustment may be made automatically responsive to a railroad company's policy for handling departures from plan, or manually as the on-board operator and dispatcher jointly decide the best approach for returning to plan. However, such systems may factor in an error of about 1 mph (about 1.609 kilometers/hour) in the detection of the actual speed, and/or may accept a 1 mph (1.609 kilometers/hour) difference in the actual speed and planned speed. Therefore, over a sustained period, if the speed error is accepted without adjusting the speed the train may not reach destinations or intermediate points of interest at estimated arrival times.

BRIEF DESCRIPTION OF THE INVENTION

An embodiment of the present invention relates to a system for regulating the speed, power, and/or position of a powered vehicle, which is traveling according to a planned trip. The system comprises a database, one or more controllers, and a regulator. The database comprises data relating to a plurality of planned parameters, the planned parameters including a plurality of planned elapsed travel times relative to a time at which the vehicle started traveling according to the planned trip. For each planned elapsed travel time there is an associated planned speed, planned power, and planned position of the vehicle according to the planned trip. The one or more controllers provide data relating to operating parameters of the vehicle, for example, a current operating speed, operating power, operating position, and operating elapsed travel time of the vehicle during execution of the planned trip. The regulator is configured to carry out a comparison of a selected one or more of any of the operating parameters each to a respective one of the planned parameters. (In one embodiment, for example, the regulator is operable in plural modes, including a first mode where all the planned parameters are compared to respective operating parameters and a second mode where a single selected planned parameter is compared to a respective operating parameter.) The regulator is further configured to adjust the operating speed and/or operating power of the vehicle based on the comparison.

In another embodiment, the regulator is further configured to adjust the operating speed and/or operating power of the vehicle if a difference between an operating parameter and a respective planned parameter of the comparison is beyond a predetermined threshold.

In another embodiment, the regulator is configured to adjust the operating speed of the vehicle within a predetermined range of the operating speed of the vehicle. Meaning the operating speed is adjusted from a current operating speed to a new operating speed within the predetermined range of the current operating speed.

In another embodiment, the database further comprises planned fuel consumption data. The planned fuel consumption data comprises a planned amount of fuel consumed by the vehicle while traveling according to the planned trip, a planned amount of fuel remaining for consumption by the vehicle for traveling on the planned trip, and/or a planned rate at which the vehicle has consumed fuel. The planned amount of fuel consumed, planned amount of fuel remaining, and/or planned rate are associated with the planned travel times. In this embodiment, the one or more controllers provide operating fuel consumption data relating to fuel consumption of the vehicle. The operating fuel consumption data comprises an operating amount of fuel consumed by the vehicle while traveling on the planned trip, an operating amount of fuel remaining for consumption of the vehicle for traveling on the planned trip, and/or an operating rate at which the vehicle has consumed fuel while traveling on the planned trip. Further, the regulator adjusts the operating speed according to a comparison of the planned fuel consumption data to the operating fuel consumption data.

In another embodiment, the system further comprises an estimator controller that updates the planned trip and the database including updating data relative to the planned speed at associated planned travel times.

Another embodiment relates to a method for regulating the speed, power, and/or position of a powered vehicle, which is traveling according to a planned trip. The method comprises accessing a database having data relating to a plurality of planned parameters. The planned parameters comprise a plurality of planned elapsed travel times relative to a time at which the vehicle started traveling according to the planned trip. For each planned elapsed travel time there is an associated planned speed, planned power, and planned position of the vehicle according to the planned trip. The method further comprises providing data relating to operating parameters of the vehicle. The operating parameters comprise a current operating speed, operating power, operating position, and elapsed operating time of the vehicle during execution of the planned trip. The method further comprises carrying out a comparison of a selected one or more of any of the operating parameters each to a respective one of the planned parameters, and adjusting the operating speed and/or operating power of the vehicle based on the comparison.

In another embodiment of the method, the operating speed and/or operating power of the vehicle is adjusted if a difference between an operating parameter and a respective planned parameter of the comparison is beyond a predetermined threshold.

In another embodiment of the method, the comparison comprises a selected one or more of any of a comparison between the operating position and a planned position at an associated planned elapsed travel time, a comparison between the elapsed operating time and an planned elapsed travel time at an associated planned position, a comparison between the operating speed and a planned speed at an associated planned position, and a comparison between the operating power and a planned power at an associated planned position.

In another embodiment of the method, the step of adjusting the operating speed and/or operating power comprises adjusting the operating speed and/or operating power to equal the planned speed and/or planned power within a range of planned speeds and/or planned powers defined by the planned speed and a threshold speed and/or the planned power and a threshold power, respectively.

In another embodiment, the database further comprises planned fuel consumption data. The planned fuel consumption data comprise a planned amount of fuel consumed by the vehicle while traveling according to the planned trip, a planned amount of fuel remaining for consumption by the vehicle for traveling on the planned trip, and/or a planned rate at which the vehicle has consumed fuel. The planned amount of fuel consumed, planned amount of fuel remaining, and/or planned rate are associated with the planned travel times. Additionally, the method further comprises providing operating fuel consumption data relating to fuel consumption of the vehicle. The operating fuel consumption data comprises an operating amount of fuel consumed by the vehicle while traveling on the planned trip, an operating amount of fuel remaining for consumption of the vehicle for traveling on the planned trip, and/or an operating rate at which the vehicle has consumed fuel while traveling on the planned trip. The method further comprises adjusting the operating speed according to a comparison of the planned fuel consumption data to the operating fuel consumption data.

In another embodiment, the method further comprises monitoring the operating position of the vehicle and associated elapsed operating time of the vehicle, providing data relative to a planned position of the vehicle associated with a planned travel time (the planned travel time corresponding to the elapsed operating time), comparing the operating position to the planned position, and adjusting the speed of the vehicle if the operating position is not within a predetermined range of the planned position.

In another embodiment, the method further comprises updating the planned trip and the database, including updating data relative to the planned parameters at associated planned times or planned positions when the vehicle is traveling according to the planned trip.

Another embodiment of the present invention relates to a system for regulating the speed, power, and/or position of a locomotive linked with a plurality of railcars forming a train, which is traveling on a track system according to a planned trip. The system comprises a database, one or more controllers, and a regulator. The database includes planned trip data relative to the planned trip. The planned trip data includes a plurality of planned elapsed travel times relative to a time at which the locomotive started traveling on the route, and for each planned elapsed travel time there is an associated planned speed, planned power, and planned position of the locomotive according to the planned trip. The database further comprises planned fuel consumption data. The planned fuel consumption data comprises a planned amount of fuel consumed by the locomotive while traveling according to the planned trip, a planned amount of fuel remaining for consumption by the locomotive for traveling on the planned trip, and/or a planned rate at which the locomotive has consumed fuel. The planned amount of fuel consumed, planned amount of fuel remaining, and/or planned rate being associated with the planned elapsed travel times. The one or more controllers provide locomotive operating data. The operating data comprises data relating to an operating speed of the locomotive, an operating power of the locomotive, and an operating position of the locomotive. The operating speed, operating power, and operation position are associated with an operating elapsed travel time of the locomotive. The locomotive operating data also includes operating fuel consumption data of the locomotive. The regulator carries out a first comparison of the operating speed, operating power, and/or operating position to the respective planned speed, planned power, and/or planned position at an associated elapsed travel time, and adjusts the operating speed of the locomotive based on the first comparison. The regulator also carries out a second comparison of the planned fuel consumption data to the operating fuel consumption data at the associated elapsed travel time, and adjusts the speed of the locomotive based on the second comparison.

BRIEF DESCRIPTION OF THE DRAWINGS

The present invention can be more easily understood and the further advantages and uses thereof more readily apparent, when considered in view of the following detailed description when read in conjunction with the following figures, wherein.

DETAILED DESCRIPTION OF THE INVENTION

Figure 1:
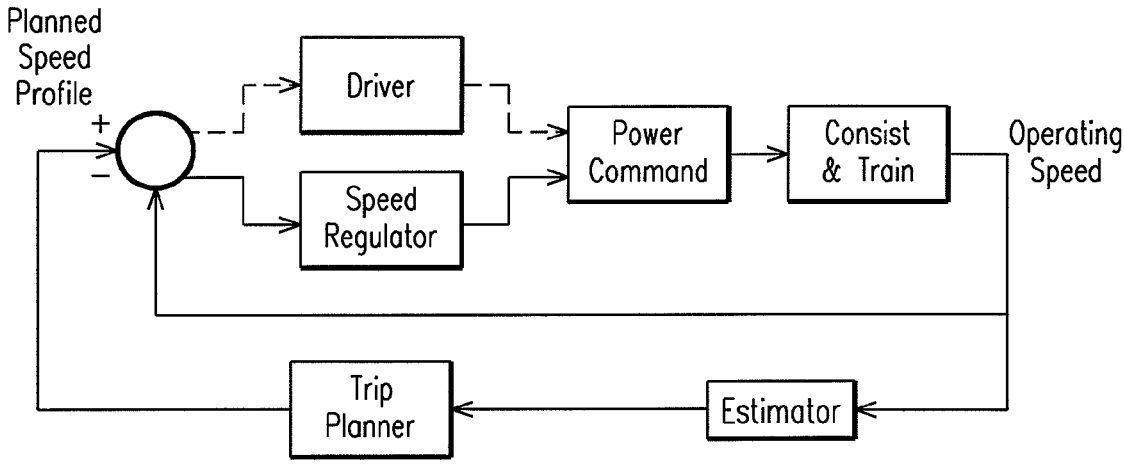
FIG. 1 PRIOR ART
FIG. 1 is a schematic illustration of a closed loop trip optimizing system in the prior art.

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained. While the invention is described below in reference to locomotives and trains, the invention is not so limited. The invention may be used with other vehicles including marine vessels, off-highway vehicles, on-road vehicles, etc. The term "powered vehicle" as used herein shall comprise the vehicles that have an onboard power source sufficient to propel the vehicle and possibly others in a series of vehicles. In the case of trains traveling on railroad tracks, the locomotive is the powered vehicle. The term "track" as used herein shall comprise different pathways, such as off-road, off-highway, roads, marine pathways, or railroad tracks traveled by powered vehicles. In addition, the terms "geographic coordinates" or "coordinates" comprises one or more track locations or locations of a vehicle on a track. The locations may be characterized or determined in any number of ways, including, but not limited to providing longitudinal, latitudinal or elevational coordinates or providing the distance a point or location is from a fixed reference such as a vehicle start or destination location or a mile marker positioned along the track.

Before describing in detail the particular method and apparatus for regulating the speed, power, and position of a powered vehicle in accordance with embodiments of the present invention, it should be observed that the present invention resides primarily in a novel combination of hardware and software elements related to said method and apparatus. Accordingly, the hardware and software elements have been represented by conventional elements in the drawings, showing only those specific details that are pertinent to the present invention, so as not to obscure the disclosure with structural details that will be readily apparent to those skilled in the art having the benefit of the description herein.

Figure 2:
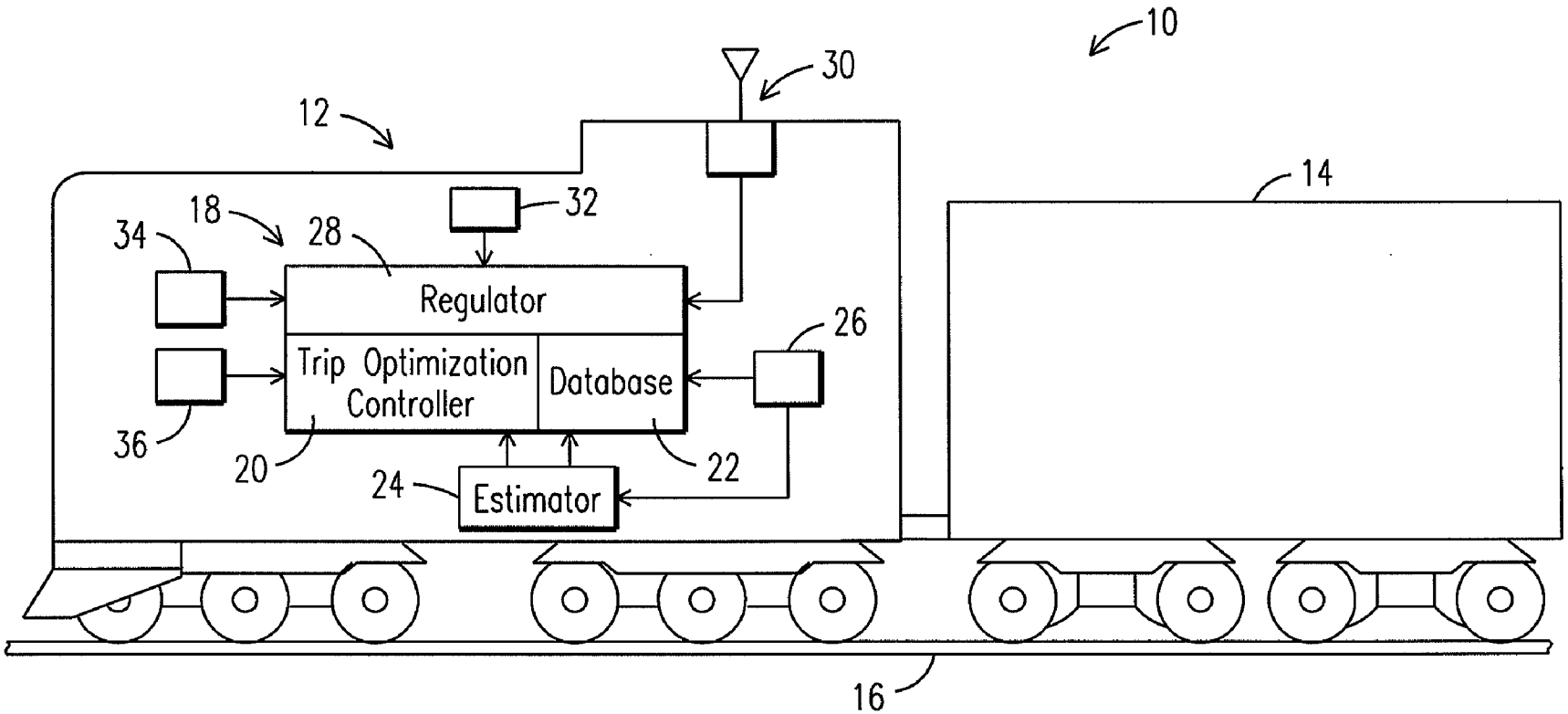
FIG. 2 is an illustration of a locomotive and train incorporating an embodiment of the invention.

With respect to FIG. 2, there is a schematic illustration of a train 10 including a locomotive 12 and a plurality of railcars 14 traveling on a railroad track 16. The train 10 is equipped with a system 18 that controls or regulates the speed, power, or position of the locomotive 12 in accordance with a planned trip generated from a trip optimization system 20 for the locomotive 12 to follow on the track 16. The system 18 may include a database 22 that comprises data relative to the planned trip for the locomotive 12 to follow on the track 16. The planned trip and database 22 may comprise data relative to the identification of the different tracks 16 that the locomotive 12 will travel on, identification of starting location and destinations along the track 16 or intermediate points of interest, and the speed and/or power (e.g., throttle settings) at which the locomotive 12 will travel on the track at different positions or locations on the track and at different time increments during the trip. In addition, the trip plan data may include data relative to a planned position. The described trip plan data is not intended to be all inclusive, and other data may be available for operation of the locomotive 12. Moreover, in an embodiment the planned trip followed and the parameters of the trip may be intended to optimize the fuel consumption and/or minimize emissions during the course of travelling along the planned trip. In addition, the trip plan may be updated according to various operating conditions taking place during the course of travel of the locomotive 12 and train 10 on the track 16.

The trip optimization system 20 may include a first controller, either onboard or off-board, that is configured to generate the planned trip in response to an entry of data relative to the train 10, locomotive 12, and track 16. More specifically, information or data relative to the operation of the locomotive 12 such as the train weight, health of the locomotive and railcars, starting location, destinations, start time, arrival time, and track profile data such as track grade and curvature, is input to the trip optimization system (e.g., first controller) 20 to develop the planned trip. The database 22 is maintained to include the trip plan data including, for example, data relative to the planned trip, e.g., planned speed, planned power (e.g., notch or other throttle settings), and/or planned position of the locomotive, each associated with a plurality of elapsed travel times. In addition, the trip plan data may also have the respective planned speed and planned power associated with a plurality of planned positions on the track 16. This data may be provided to the locomotive 12 according to various techniques and processes, such as, but not limited to, manual operator entry into the locomotive 12 via an onboard display, linking to a data storage device such as a hard card, hard drive, and/or USB drive, or transmitting the information via a wireless communications channel from a central or wayside location, such as a track signaling device and/or a wayside device, to the locomotive 12. Locomotive 12 and train 10 load characteristics (e.g., drag) may also change over the trip (e.g., with altitude, ambient temperature, and condition of the rails and rail-cars), causing a plan update to reflect such changes according to any of the methods discussed above. The updated data that affects the trip optimization process can be supplied by any of the methods and techniques described above and/or by real-time autonomous collection of locomotive/train conditions. Such updates include, for example, changes in locomotive or train characteristics detected by monitoring equipment on or off board the locomotive(s) 12.

To that end, an estimator controller 24 may be incorporated into the system 18 that provides updated data to the first controller 20 to update the trip plan as conditions relative to the train 10, locomotive 12, or track 16 may change. For example, ambient conditions may change and affect the trip plan, the length and weight of the train may change as a result of dropping or adding railcars, or the health of the locomotive 12 and railcars 14 may change during the course of traveling on the track 16. Accordingly, sensors 26 may be located on the locomotive 12 and railcars 14 to detect various operating conditions, and such information is transmitted to the estimator controller 24 to update the trip plan.

A second controller 28, also referred to as a regulator, adjusts the speed or power setting of the locomotive 12 responsive to information relating to current locomotive operating conditions provided to the controller/regulator 28. These adjustments are made in response to comparisons of locomotive operating conditions to the planned trip conditions stored in the database 22. The system 18 may comprise components for inputting data relative to the locomotive operating speed, time, power, and position. For example, a GPS transceiver 30 is provided and determines a position/location of the train 10 or locomotive 12 on the track 16, which is provided to the regulator 28 or otherwise. Examples of other systems that determine a position/location of the train 10 or locomotive 12 on the track 16 may include, but are not limited to, wayside devices, such as radio frequency automatic equipment identification (RF AEI) tags, dispatch, and/or video-based determinations. Another system may use tachometer(s) aboard a locomotive 12 and distance calculations from a reference point. In addition, or alternatively, the regulator 28 may include a module 32 (which may also be provided as a separate controller) that is configured with one more algorithms to calculate the position based on a fixed reference point such as a starting location or wayside equipment such as a mile marker, wayside signal, or switch for example.

In an embodiment, the database 22 may include data relative to one or more planned speeds, planned powers (e.g., notch/throttle settings), or planned positions of the locomotive 12 each associated with a plurality of time increments making up the planned trip. By way of example, for a planned trip that is to take ten hours, the database 22 may include data relative to a planned speed 48 for every thirty second time increment of the planned trip. Accordingly, the regulator 28 may include a time module 34 and operating speed module 36 either as components of the controller/regulator 28, or as separate controllers to provide data relative to locomotive 12 operating time and speed. The planned trip may be divided into segments for which the locomotive 12 and train 10 are expected to be moving on the track 16, including a plurality of planned speeds 48, planned powers 50, and planned positions 52 associated with the time increments for a section of the planned trip. In this manner, the system 10 may accurately associate an operating time increment with an operating speed. The time module may be deactivated during periods when the locomotive 12 is stopped, especially for those instances the locomotive 12 is unexpectedly stopped and not anticipated by the planned trip.

In addition, the data in database 22 may include the data relative to the planned speeds and planned power wherein each of which is associated with a planned position. For example, for every tenth of a mile along the track there may be an associated planned speed 48 and power 50. The database 22 may also be organized in terms of planned position, speed, and power as a function of time.

Figure 3:
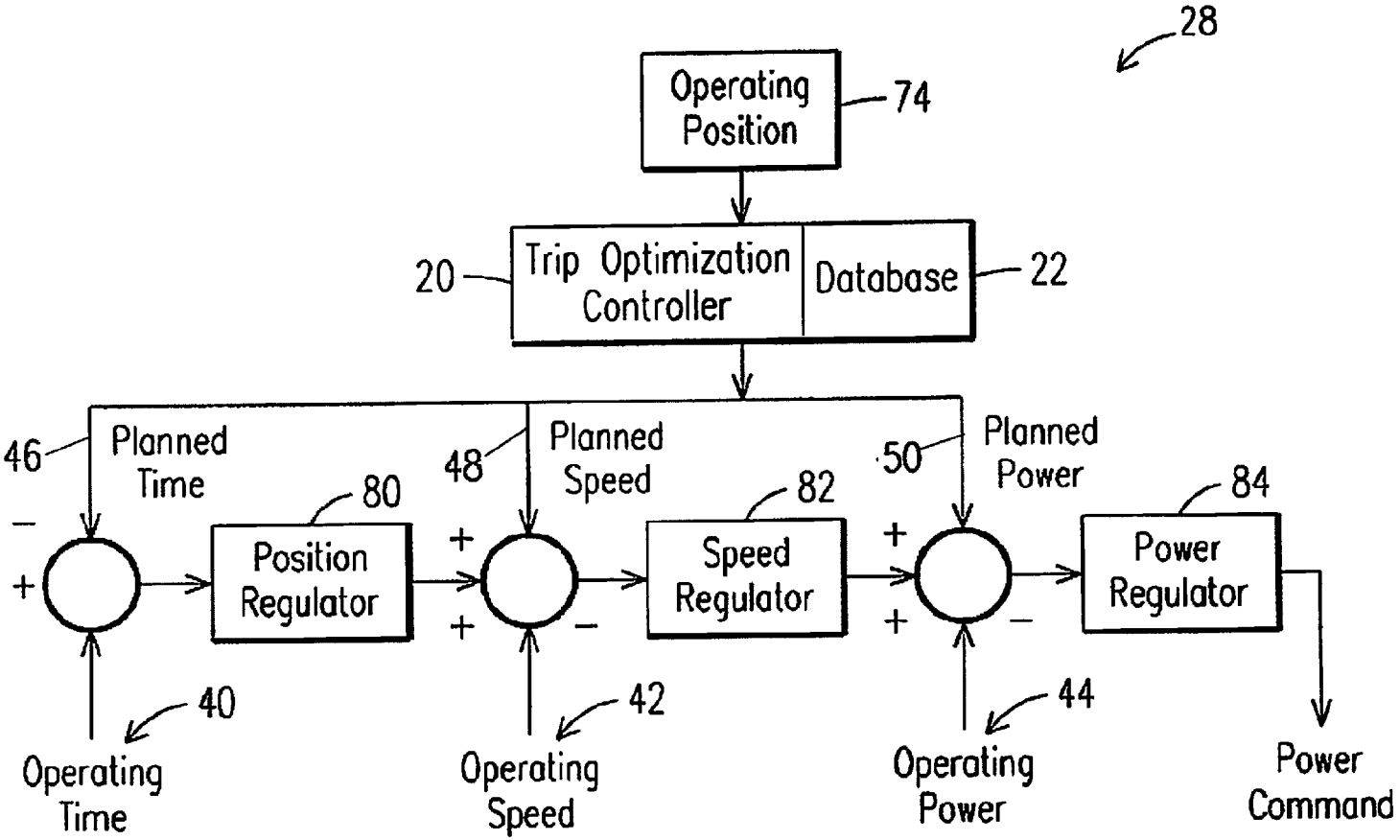
FIG. 3 is a flow chart depicting an embodiment of the invention.

The system 18 and/or regulator 28 may be configured to operate in several different modes. With respect to FIG. 3, there is provided a schematic illustration of the controller 28 that is configured to adjust the speed or power of the locomotive 12 responsive to a comparison of the operating conditions to the planned conditions. The operating position 74 is provided to a trip plan look up table provided in the database 22, and the trip optimization system 20 (e.g., first controller) is configured, based on the current operating position 74 of the locomotive 12, to provide the planned time 46, planned speed 48, and planned power 50. Alternatively, the operating time 40 may be provided to the trip optimization system 20 to provide the planned speed, planned power, or planned position associated with the elapsed operating time 40.

The controller 28 is provided with position regulator module 80, a speed regulator module 82, and a power regulator module 84. With respect to FIG. 3, the controller 28 may monitor and adjust the speed or power of the locomotive 12 as a function of either time or position of the locomotive 12. More specifically, if position module 80 is activated, the regulator 28 may adjust the speed or power by comparing the operating position 74 with the planned position 52 of the locomotive 12 at the associated elapsed travel time and adjust the speed or power accordingly if the locomotive 12 is not operating within predetermined limits or thresholds set forth in the planned trip. For example, if the locomotive 12 is not within a five mile limit of the planned position 74 at the planned time, the regulator 28 may increase or decrease the speed or power depending on whether the train 10 is behind or ahead of schedule.

In some instances during the operation of a trip plan, timing may not be a parameter considered in adjusting speed, power, or position of the locomotive 12. For example, the locomotive 12 and train 10 may be passing through an area on the track 16 that has certain speed restrictions, and despite the fact that locomotive 12 is traveling on or behind schedule the locomotive 12 must slow to a speed limit to comply with civil speed limits. Alternatively, fuel consumption may be a priority in the trip plan so speed adjustments are made to optimize fuel consumption during the trip. Thus, the trip plan may provide that at certain points of interest on the route, the position regulator module 80 is bypassed or not active. In such a case, the speed regulator module 82 of the controller 28 may compare the operating speed 42 to the planned speed 48 at the current operating position 74 to determine if a speed adjustment is necessary. The power regulator module 84 may be similarly utilized by bypassing the position regulator module 80 and speed regulator module 82. In this manner, the regulator 28 and locomotive control system 18 provides some flexibility in achieving goals provided in the trip plan.

Figure 4:
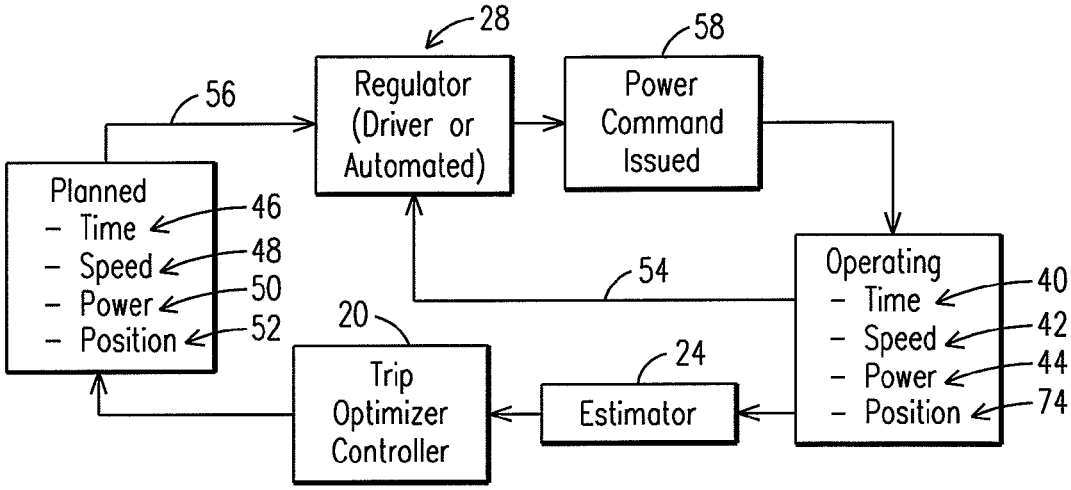
FIG. 4 is a flow chart depicting a second embodiment of the invention.

With respect to FIG. 4, there is illustrated a flow chart for a closed looped system 18 that includes the regulator 28, which may be a human operator, or an automated system that can adjust the speed of the locomotive 12 responsive to comparisons of the operating speed 42 and planned speed 48. In addition or alternatively, the regulator 28 may display a command or issue a signal to adjust the speed at which point the human operator may manually adjust the speed. In step 58, the regulator 28 issues a power command that may include starting the locomotive 12 moving on the track 16, or adjusting the speed of the locomotive 12 on the track 16. At step 54, operating parameter data such as a current operating time 40, which may include an elapsed time from some time reference such as the time elapsed from traveling from a fixed point, the operating speed 42 and/or power 44 associated with the operating time 40, and the associated operating position 74 is sent to the regulator/controller 28.

In addition, the planned speed 48 and/or planned power 50 associated with a predetermined time 46 and planned position 52 are sent from the optimization system 20 (e.g., first controller) to the regulator 28 in step 56. As described, the regulator 28 may have a controller component that is configured to receive and evaluate data relative to the planned parameters and the operating parameters. For example, if the locomotive 12 is not operating at the planned speed 48 associated with the planned time 46, the regulator 28 may adjust the operating speed 42 of the locomotive 12 accordingly. The regulator 28 may be configured to not adjust the operating speed 42 of the locomotive 28, if the operating speed 42 is within some predetermined range of the planned speed 48. If the operating speed falls outside the predetermined range, the regulator 28 may adjust the speed accordingly. In this manner, if the locomotive 12 is travelling faster than the planned speed 48, the regulator 28 may reduce the speed, which may result in a savings of fuel or avoid potential conflict with other trains traveling on the track 16.

In addition, the system 18 may monitor an operating position 74 relative to a planned position 52 and planned elapsed 46 time of travel. Operating position data may be provided by a controller/module 32 (FIG. 2) and/or the GPS transceiver 30 (FIG. 2). Accordingly, the operating position 74 is compared to the planned position 72 at an elapsed time 46. If the locomotive 12 is behind schedule, for example not within a predetermined number of miles at the planned elapsed time 46, the operating speed 42 may be increased to comply with the trip plan. In addition, as described above, the other factors such as whether the locomotive is travelling at the planned speed 48 relative to travel time 46 may be considered in rendering a decision to adjust the operating speed 42 or not. Also, fuel consumption data may be considered as described in more detail below.

Figure 5:
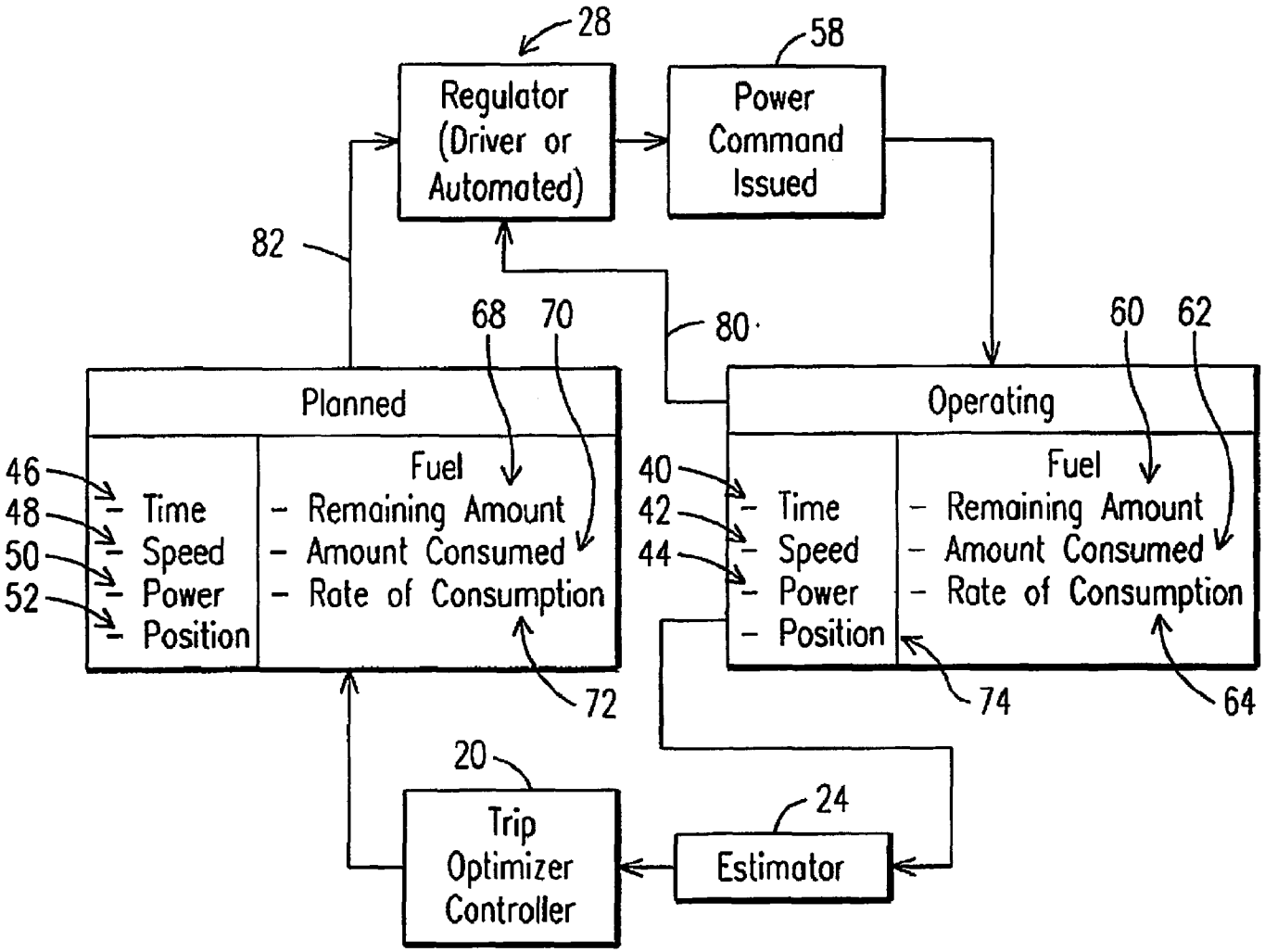
FIG. 5 is a schematic illustration of the regulator controller for controlling speed of a powered vehicle according to time, position and power.

In an embodiment illustrated in FIG. 5, the regulator 28 is configured to factor in fuel consumption relative to adjusting the operating speed 42. More specifically, in addition to the operating time 40, speed 42, and power 44 being transmitted to controller/regulator 28, operating fuel consumption data may be transmitted to the controller/regulator 28. For example, data relative to the remaining amount of fuel 60, the amount of fuel consumed 62, and/or rate of fuel consumption 64 associated with an elapsed operating time 40 may be transmitted to the controller 28 at step 80. In addition, at step 82 the optimization system 20 (e.g., first controller) transmits data relative to a planned fuel consumption (such as a planned remaining fuel 68, planned amount consumed 70, and/or planned rate of consumption 72 associated with a planned travel time) to the controller/regulator 28.

In this manner, the regulator 28 may factor in fuel consumption data relative to operating time 40 in the decision to adjust the operating speed 42. For example, if the operating speed 42 of the locomotive 12 is less than a threshold for the planned speed at a given operating time 40, the controller 28 may be configured to determine whether the amount of fuel consumed associated with the operating time is within the planned trip parameters. If the operating fuel consumption 62 exceeds the planned fuel consumption 70, the controller 28 may be configured so that fuel consumption is a priority and will not increase the operating speed 42 to meet the threshold planned speed 48. Alternatively, if the operating fuel consumption 62 is less than the planned fuel consumption 70, the controller 28 may increase the operating speed 42 of the locomotive 12 to meet the threshold planned speed 48.

Embodiments of the invention may also be implemented in a programmable computer readable media for regulating the speed of the locomotive 12 traveling on the track 16 according to the predetermined route in the trip plan that includes one or more planned speed settings at which the vehicle may travel on the route. The computer readable media may include one or more computer modules for storing a database 22 having data relative to the trip plan including the predetermined route that the vehicle 12 may travel on the track 16 including a plurality of elapsed planned travel times 46 relative to a time at which the vehicle started traveling on the route. For each elapsed travel time 46 there is an associated planned speed 48 and planned power 50 of the vehicle 12 according to the trip plan. In addition, one or more computer modules are provided for monitoring and providing operating parameter data including an operating speed 42, operating position 74, operating power 44, and an operating travel time 40 for the locomotive 12 during the course of traveling the predetermined route of the planned trip.

In addition, there may be a computer module 28 for comparing the operating speed 42 to the planned speed 48, the operating power 44 to the planned power 50, and/or the operating position 74 to the planned position 52 at the associated elapsed travel time 40; and, one or more computer modules for adjusting the operating speed 42 of the vehicle if the difference between the vehicle operating speed 42 and planned speed 48 is beyond a predetermined threshold speed.

Operating power and planned power may refer to an operating power setting and planned power setting, respectively, for example a notch or other throttle setting. In other embodiments, the operating power and planned power are a power output of the train 10 or other vehicle, e.g., horsepower output.

Embodiments described above may be implemented on a suitable computer system, controller, memory, or generally a computer readable medium. For example, the steps of the methods described above may correspond to computer instructions, logic, software code, or other computer modules disposed on the computer readable medium, e.g., floppy disc, hard drive, ASIC, remote storage, optical disc, or the like. The computer-implemented methods and/or computer code may be programmed into an electronic control unit of an engine, a main control system of the locomotive, a remote control station that communicates with the locomotive unit, or the like, as described above.

While various embodiments of the present invention have been shown and described herein, it will be obvious that such embodiments are provided by way of example only and not of limitation. Numerous variations, changes and substitutions will occur to those skilled in the art without departing from the teaching of the present invention. Moreover, unless specifically stated, any use of the terms first, second, selected, etc. do not denote any order or importance, but rather the terms first, second, selected, etc. are used to distinguish one element from another. Accordingly, it is intended that the invention be interpreted within the full spirit and scope of the appended claims.

That which is claimed:

1. A system comprising:

a database having data relating to a plurality of planned parameters, the planned parameters comprising a plurality of planned elapsed travel times relative to a time at which a powered vehicle started traveling according to a planned trip, wherein the planned elapsed travel times are associated with at least one of a planned speed, a planned power, or a planned position of the vehicle according to the planned trip;

one or more controllers configured to provide data relating to operating parameters of the vehicle, the operating parameters comprising at least one of a current operating speed, a current operating power, a current operating position, or a current operating elapsed travel time of the vehicle during execution of the planned trip; and a regulator configured to carry out a comparison of one or more of the operating parameters to one or more of the planned parameters during the execution of the planned trip;

wherein the regulator is further configured to adjust at least one of the operating speed or the operating power of the vehicle based on the comparison.

2. The system of claim 1, wherein the regulator is further configured to adjust the at least one of the operating speed or the operating power of the vehicle if a difference between the one or more of the operating parameters and the one or more of the planned parameters of the comparison exceeds a predetermined threshold.

3. The system of claim 1, wherein the regulator is configured to adjust the operating speed of the vehicle to within a predetermined range of the planned speed of the vehicle.

4. The system of claim 1, wherein the database further comprises planned fuel consumption data that includes at least one of a planned amount of fuel consumed by the vehicle while traveling according to the planned trip, a planned amount of fuel remaining for consumption by the vehicle for traveling on the planned trip, or a planned rate at which the vehicle is to consume fuel, wherein the at least one of the planned amount of fuel consumed, the planned amount of fuel remaining, or the planned rate is associated with the planned elapsed travel times;

wherein the one or more controllers are configured to provide operating fuel consumption data relating to fuel consumption of the vehicle, the operating fuel consumption data including at least one of an operating amount of fuel consumed by the vehicle while traveling on the planned trip, an operating amount of fuel remaining for consumption by the vehicle for traveling on the planned trip, or an operating rate at which the vehicle has consumed fuel while traveling on the planned trip; and wherein the regulator is configured to carry out a comparison of the planned fuel consumption data and the operating fuel consumption data and to adjust the at least one of the operating speed or the operating power based on the comparison of the planned fuel consumption data and the operating fuel consumption data.

5. The system of claim 1, further comprising an estimator controller configured to update the planned trip and the database by updating the data relative to the at least one of the planned speed, the planned power, or the planned position at the planned elapsed travel times that are associated with the at least one of the planned speed, the planned power, or the planned position.

6. A method comprising:

accessing a database having data relating to a plurality of planned parameters, the planned parameters comprising a plurality of planned elapsed travel times relative to a time at which a vehicle started traveling according to a planned trip, wherein the planned elapsed travel times are associated with at least one of a planned speed, a planned power, or a planned position of the vehicle according to the planned trip;

providing data representative of operating parameters of the vehicle, the operating parameters comprising at least one of a current operating speed, a current operating power, a current operating position, or an elapsed operating time of the vehicle during execution of the planned trip;

carrying out a comparison of one or more of the operating parameters to one or more of the planned parameters during the execution of the planned trip; and adjusting at least one of the operating speed or the operating power of the vehicle based on the comparison.

7. The method of claim 6, wherein the at least one of the operating speed or the operating power of the vehicle is adjusted if a difference between the one or more of the operating parameters and the one or more of the planned parameters of the comparison exceeds a predetermined threshold.

8. The method of claim 6, wherein carrying out the comparison comprises comparing at least one of: the operating position and at least one of the planned positions that is associated with at least one of the planned elapsed travel times, the elapsed operating time and the at least one of the planned elapsed travel times, the operating speed and the planned speed associated with the at least one of the planned positions, the operating power and the planned power associated with the at least one of the planned positions.

9. The method of claim 6, wherein adjusting the at least one of the operating speed or the operating power comprises controlling the at least one of the operating speed or the operating power to be within a range of a threshold speed that is based on a corresponding one of the planned speeds or a threshold power that is based on a corresponding one of the planned powers, respectively.

10. The method of claim 6, wherein the database further comprises planned fuel consumption data that includes at least one of a planned amount of fuel consumed by the vehicle while traveling according to the planned trip, a planned amount of fuel remaining for consumption by the vehicle for traveling on the planned trip, or a planned rate at which the vehicle is expected to consume fuel, wherein the at least one of the planned amount of fuel consumed, the planned amount of fuel remaining, or the planned rate is associated with the planned elapsed travel times; and the method further comprises:

providing operating fuel consumption data relating to fuel consumption of the vehicle that includes at least one of an operating amount of fuel consumed by the vehicle while traveling on the planned trip, an operating amount of fuel remaining for consumption of the vehicle for traveling on the planned trip, or an operating rate at which the vehicle has consumed fuel while traveling on the planned trip; and adjusting at least one of the operating speed or the operating power according to a comparison of the planned fuel consumption data to the operating fuel consumption data.

11. The method of claim 6, further comprising:

monitoring the operating position of the vehicle and the elapsed operating time of the vehicle that corresponds to the operating position;

providing data relative to the planned position of the vehicle that is associated with the planned elapsed travel time;

comparing the operating position to the planned position; and adjusting at least one of the operating speed or the operating power of the vehicle when the operating position is outside of a predetermined range of the planned position.

12. The method of claim 6, further comprising updating the planned trip and the data relating to the planned parameters when the vehicle is traveling according to the planned trip.

13. A system comprising:

a database having planned trip data for a planned trip of a rail vehicle having at least one powered unit, wherein the planned trip data includes a plurality of planned elapsed travel times relative to a time at which the rail vehicle started traveling on a route and the planned elapsed travel times are associated with at least one of a planned speed, a planned power, or a planned position of the rail vehicle according to the planned trip;

wherein the database further comprises planned fuel consumption data that includes at least one of a planned amount of fuel consumed by the rail vehicle while traveling according to the planned trip, a planned amount of fuel remaining for consumption by the rail vehicle for traveling on the planned trip, or a planned rate at which the rail vehicle is expected to consume fuel, wherein the at least one of the planned amount of fuel consumed, the planned amount of fuel remaining, or the planned rate is associated with the planned elapsed travel times;

one or more controllers configured to provide operating data that includes data representative of at least one of an operating speed of the rail vehicle, an operating power of the rail vehicle, or an operating position of the rail vehicle, wherein the at least one of the operating speed, the operating power, or the operation position is associated with an operating elapsed travel time of the rail vehicle, and the operating data also includes operating fuel consumption data of the rail vehicle; and a regulator configured to carry out a first comparison of the at least one of the operating speed, the operating power, or the operating position to a corresponding one of the at least one of the planned speed, the planned power, or the planned position at the elapsed travel time associated with the at least one of the planned speed; the planned power, or the planned position, and the regulator is configured to adjust the operating speed of the rail vehicle based on the first comparison, wherein the regulator also is configured to carry out a second comparison of the planned fuel consumption data to the operating fuel consumption data at the elapsed travel time associated with the at least one of the planned speed, the planned power, or the planned position, and the regulator is configured to adjust the operating speed of the rail vehicle based on the second comparison.

14. The system of claim 13, wherein the regulator is configured to adjust the operating speed of the rail vehicle:

when a difference between the operating speed and the planned speed of the first comparison exceeds a first predetermined threshold, or when a difference between the operating fuel consumption data and the planned fuel consumption data of the second comparison exceeds a second predetermined threshold.

15. The system of claim 14, wherein the regulator maintains or decreases the operating speed of the rail vehicle when the difference between the operating speed and the planned speed is below the first predetermined threshold and the operating fuel consumption data indicates that actual fuel consumption of the rail vehicle exceeds the planned fuel consumption.

16. The system of claim 14, wherein the regulator is configured to adjust the operating speed of the rail vehicle when the difference between the operating speed and the planned speed exceeds the first predetermined threshold and the difference between the operating fuel consumption data and the planned fuel consumption data is no greater than the second predetermined threshold.

17. The system of claim 14, wherein the regulator is configured to adjust the operating speed of the rail vehicle when the difference between the operating fuel consumption and the planned fuel consumption exceeds the second predetermined threshold and the difference between the operating speed and the planned speed is no greater than the first predetermined threshold.

18. A non-transitory programmable computer readable media comprising one or more computer modules configured to direct one or more controllers disposed onboard a powered vehicle to:

obtain data associated with a predetermined route over which the vehicle is to travel, the data including a plurality of elapsed travel times relative to a time at which the vehicle started traveling on the route and planned speeds of the vehicle that are associated with different elapsed travel times;

monitor an operating speed and operating elapsed travel time for the vehicle during travel of the vehicle along the route;

compare the operating speed to the planned speed at one or more common elapsed travel times associated with the operating speed and the planned speed; and adjust the operating speed of the vehicle based on a difference between the operating speed and the planned speed.

19. A system comprising:

a controller configured to be disposed onboard a powered vehicle and to obtain a trip plan that includes at least one of designated speeds of the vehicle, designated power outputs of the vehicle, or designated positions of the vehicle associated with different travel times of the vehicle along a designated route, the controller also configured to monitor at least one of actual operational speeds, operational power outputs, or operational positions of the vehicle at one or more of the different travel times of the trip plan; and a regulator configured to be disposed onboard the vehicle and to compare the at least one of the operational speeds, the operational power outputs, or the operational positions of the vehicle with the at least one of the designated speeds, the designated power outputs, or the designated positions of the trip plan to identify one or more differences, wherein the regulator is configured to change one or more of the operational speeds or the operational power outputs of the vehicle based on the one or more differences.

20. The system of claim 19, wherein the regulator is configured to autonomously change the one or more of the operational speeds or the operational power outputs of the vehicle based on the one or more differences.

21. The system of claim 19, wherein the regulator is configured to direct an operator of the vehicle to manually change the one or more of the operational speeds or the operational power outputs of the vehicle based on the one or more differences.

22. The system of claim 19, wherein the regulator is configured to compare the at least one of the operational speeds, the operational power outputs, or the operational positions of the vehicle with the at least one of the designated speeds, the designated power outputs, or the designated positions of the trip plan at common travel times of the different travel times.

* * * * *